US007791437B2

(12) United States Patent
Franson

(10) Patent No.: US 7,791,437 B2
(45) Date of Patent: Sep. 7, 2010

(54) HIGH FREQUENCY COPLANAR STRIP TRANSMISSION LINE ON A LOSSY SUBSTRATE

(75) Inventor: Steven J. Franson, Scottsdale, AZ (US)

(73) Assignee: Motorola, Inc., Schaumburg, IL (US)

( * ) Notice: Subject to any disclaimer, the term of this patent is extended or adjusted under 35 U.S.C. 154(b) by 875 days.

(21) Appl. No.: 11/675,152

(22) Filed: Feb. 15, 2007

(65) Prior Publication Data

US 2008/0197945 A1 Aug. 21, 2008

(51) Int. Cl.
*H01P 3/08* (2006.01)
*H01P 5/00* (2006.01)

(52) U.S. Cl. ..... 333/238; 333/1

(58) Field of Classification Search ..... 333/236, 333/238, 245, 246, 1
See application file for complete search history.

(56) References Cited

U.S. PATENT DOCUMENTS

| | | | | |
|---|---|---|---|---|
| 4,575,700 | A | 3/1986 | Dalman | |
| 5,061,943 | A | 10/1991 | Rammos | |
| 5,426,399 | A * | 6/1995 | Matsubayashi et al. | 333/1 |
| 6,023,209 | A | 2/2000 | Faulkner et al. | |
| 6,552,691 | B2 | 4/2003 | Mohuchy et al. | |
| 6,888,427 | B2 * | 5/2005 | Sinsheimer et al. | 333/238 |
| 6,975,275 | B2 | 12/2005 | Choi | |
| 7,050,013 | B2 | 5/2006 | Kim et al. | |
| 7,298,234 | B2 * | 11/2007 | Dutta | 333/246 |
| 7,659,790 | B2 * | 2/2010 | Shaul et al. | 333/1 |
| 2003/0117245 | A1 | 6/2003 | Okajima et al. | |
| 2005/0190587 | A1 | 9/2005 | Greeff | |
| 2005/0219126 | A1 | 10/2005 | Rebeiz et al. | |
| 2006/0055613 | A1 | 3/2006 | Angelucci | |
| 2006/0103577 | A1 | 5/2006 | Lee | |
| 2006/0109192 | A1 | 5/2006 | Weigand | |
| 2006/0131611 | A1 | 6/2006 | Kaluzni et al. | |
| 2006/0131755 | A1 | 6/2006 | Japp et al. | |
| 2006/0139223 | A1 | 6/2006 | Li et al. | |
| 2006/0164310 | A1 | 7/2006 | Verterinen | |
| 2006/0208825 | A1 | 9/2006 | Takahashi | |
| 2007/0195004 | A1 | 8/2007 | Rebeiz et al. | |

OTHER PUBLICATIONS

Aguilar, J.R., et al,. The Microwave and RF Characteristics of FR4 Substrates, The Institute of Electrical Engineers, 1998.

Leung, L. L., et al., Characterization and Attenuation Mechanism of CMOS-Compatible Micromachined Edge-Suspended Coplanor Waveguides on Low-Resistivity Silicon Substrate, IEEE Transactions on Advanced Packaging, vol. 29, No. 3, Aug. 2006.

(Continued)

*Primary Examiner*—Dean O Takaoka

(57) ABSTRACT

A substrate having two high frequency components positioned on substrates typically used for lower frequency devices. A coplanar strip transmission line, providing for transmission of high frequency signals, comprises first, second and third parallel, spaced conductive traces positioned on a surface of the substrate, wherein the substrate defines a first slot extending from the first surface into the substrate and between the first and second parallel, spaced conductive traces and a second slot extending from the first surface into the substrate and between the first and third parallel, spaced conductive traces. Optionally, an antenna is coupled to the coplanar strip transmission line and comprises first and second antenna traces, the substrate defining a third slot therebetween.

16 Claims, 2 Drawing Sheets

OTHER PUBLICATIONS

Linardou, I., et al., Twin Vivaldi fed by coplanar waveguide, Electronic Letters, vol. 33, No. 22, Oct. 23, 1997.

Kerekes, Jim, et al., Low VSWR and Insertion Loss over a wide bandwith, MP Digest, Feb. 2006.

Kwon, Youngwoo, et al., Low-Loss Micromachined Inverted Overlay CPW Lines with Wide Impedance Ranges and Inherent Airbridge Connection Capability, IEEE Microwave and Wireless Components Letters, vol. 11, No. 2, Feb. 2001., pp. 59-61.

Nikolaou, Symeon, Double Exponentially Tapered Slot Antenna (DETSA) on Liquid Crystal Polymer (LCP) for UWB Applications, Student Paper Contest Finalist in the 2005 IEEE-APS Symposium, pp. 623-626, vol. 2A, Washington, DC, Jul. 2005.

Leung, L.L., et al., Low-Loss Coplanar Waveguides Interconnects on Low-Resistivity Silicon Substrate, IEEE Transactions on Component and Packaging Technologies, vol. 27, No. 3, Sep. 2004.

International Search Report PCT/US2008/051292 dated Jun. 23, 2008.

Seong Ji Yang, "Corresponding Application PCT/US2008/051292—PCT International Search Report and Written Opinion," WIPO, ISA/KR, Korean Intellectual Property Office, Daejeon, Republic of Korea, Jun. 23, 2008, 10 pages, most relevant pp. 6-7 and 9-10.

Philippe Becamel, "Corresponding Application PCT/US2008/051292—PCT International Preliminary Report on Patentability," The International Bureau of WIPO, Geneva, Switzerland, Aug. 27, 2009, 6 pages, most relevant, pp. 2, 5-6.

Zheng, et al., "Design and Implementation of System-on-Package for Radio and Mixed-Signal Applications," Proceedings of the 6th IEEE CPMT High Density Microsystem Design and Packaging and Component Failure Analysis, 2004, HDP'04, Jun. 30-Jul. 3, 2004, pp. 97-104.

Pinel, et al., "Low Cost V-Band Filter and Antenna on Liquid Crystal Polymer Substrate," Proceedings of the Asia-Pacific Microwave Conference 2005, APMC 2005, Dec. 4-7, 2005, vol. 3, 3 pages.

* cited by examiner

HIGH FREQUENCY COPLANAR STRIP TRANSMISSION LINE ON A LOSSY SUBSTRATE

FIELD OF THE INVENTION

The present invention generally relates to conduction of high frequency signals and more particularly to coplanar strip transmission lines for transmission of high frequency signals on substrates typically used for lower frequency devices.

BACKGROUND OF THE INVENTION

Circuits used in many electronic devices, for example, cellular phones and radios, produce, receive, or function with high frequency signals as well as low frequency signals. Integration of high and low frequency circuits typically involve the use of hybrid substrates, with low frequency devices formed on FR4, for example, and high frequency devices formed on RT/Duroid©, for example. Both the low and high frequency signals may be transmitted across a substrate or printed circuit board by metal traces; however, while low frequency signals may be transmitted along a single metal trace, the high frequency signal is typically transmitted by multiple metal traces which form a waveguide structure, such as a microstrip or coplanar trace. The coplanar trace is one in which two or more metal traces are formed on the same surface, thereby guiding an electromagnetic signal between them. These metal traces typically transmit the high frequency signal between circuits such as amplifiers, oscillators, and mixers positioned on a printed circuit board.

Coplanar circuit structures conventionally include coplanar waveguide structures and slotline structures. A coplanar waveguide structure has one or more spaced longitudinal coplanar strip signal conductors positioned between and separated from two longitudinal coplanar ground conductors by respective gap widths, wherein the ground conductors are typically much wider than the gaps. A slotline structure has two spaced longitudinal coplanar conductors having a gap therebetween, wherein the gap is typically much smaller than the lateral width of the conductors.

The metal traces of a coplanar strip transmission line conventionally are formed on a dielectric material, such as a printed circuit board. The high frequency signal exists as an electromagnetic field in the gap between the metal traces. The gap includes the dielectric material as well as air between and above the metal traces. The existence of the electric field in the dielectric material results in undesirable losses in signal strength. This is exacerbated by the electric field naturally concentrating in the higher dielectric constant material over the lower dielectric air.

This loss in signal strength may be reduced by forming the circuitry (both low and high frequency) on a high frequency substrate. However, substrates typically used for high frequency signals are much more costly than substrates typically used for low frequency signals. For circuit board applications, the loss is reduced by using high frequency substrates such as RT/duroid® from Rogers Corp, instead of traditional circuit board material, such as FR4.

Another known approach to reduce this loss in signal strength is to form a high frequency substrate material, e.g., RT/duroid®, on or over a low frequency substrate, e.g., an FR4 material. High frequency circuitry would be formed on the high frequency substrate material and the low frequency circuitry would be formed on the low frequency substrate. However, while this may be less costly than using an entire substrate of high frequency substrate material, it is still a complicated and costly process.

Accordingly, it is desirable to provide a coplanar strip transmission line for transmission of high frequency signals on substrates typically used for lower frequency devices. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A substrate provides for transmission of high frequency signals between devices formed on a material typically used for lower frequency devices. The substrate comprises a material having a first surface and defining first and second spaced, parallel slots extending from the first surface into the substrate. A first conductive trace is positioned on the first surface and between the first and second, spaced, parallel slots, and a second conductive trace positioned on the first surface and adjacent the first spaced, parallel slot and on a side of the first slot opposed to the first conductive trace. A third conductive trace positioned on the first surface and adjacent the second spaced, parallel slot and on a side of the second slot opposed to the first conductive trace.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

High frequency devices, for example, microwave and millimeter wave modules, are fabricated using existing low cost methods for fabricating lower frequency applications on low cost substrates/printed circuit boards. Standard circuit board manufacturing techniques with minimal post-processing steps enhance performance at a lower cost. Cut outs, which may also be called slots or gaps, in the substrate/printed circuit board are positioned between metal traces carrying a high frequency signal in the range of 2 to 100 gigahertz (GHz).

Figure 1:
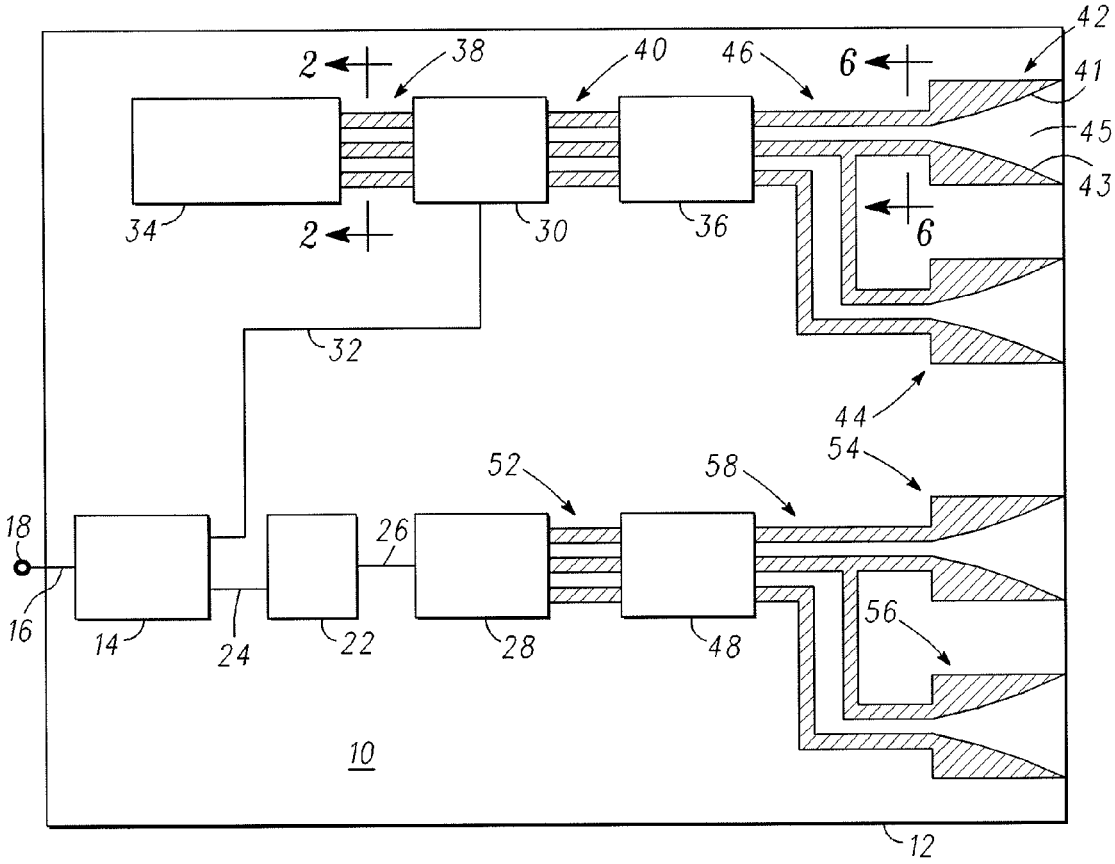
FIG. 1 is a partial block diagram and partial schematic top view of circuitry including an exemplary embodiment.

Referring to FIG. 1, a block diagram of an exemplary embodiment of an RF transmitter/receiver 10 is formed on a substrate 12. The substrate 12 preferably comprises a printed circuit board made of RF4 (flame resistant 4) material, but may comprise any material, such as epoxy resin, that comprises a lossy material. RF4 material is a composite of resin epoxy reinforced with a woven fiberglass mat and is more economical, absorbs less moisture, has great strength and stiffness and is highly flame resistant. For these reasons, RF4 material is widely used for printed circuit boards for low frequency devices. RF4 material previously has been thought to have an upper frequency limit of around 10.0 GHz.

Electronic circuitry (or components), which may comprise, for example, a receiver, a transmitter, or as shown, a transceiver, includes baseband circuits 14, a filter 22, a detector 28, a mixer 30, a local oscillator 34, an amplifier 36, a low noise amplifier 48, and antennas 42, 44, 54, 56. Baseband circuits 14 includes, e.g., a microprocessor (not shown) and has inputs traces 16 positioned to receive low frequency input signals 18 from "outside" of the substrate 12. The term "trace" is well known in the industry and is meant to be a conductive line formed on the substrate 12. The filter 22 is coupled by traces 24 and 26 between the baseband circuits 14 and the detector 28, respectively. The baseband circuits 14 are further coupled to the mixer 30 by a trace 32. The mixer 30 is coupled between the local oscillator 34 and the amplifier 36 by coplanar strip transmission lines 38 and 40, respectively. The amplifier 36 is coupled to tapered slot antennas 42 and 44 by the coplanar strip transmission line 46. The low noise amplifier 48 is coupled to the detector 28 by a coplanar strip transmission line 52 and to antennas 54 and 56 by coplanar strip transmission lines 58. The antenna elements pairs 42, 44 and 54, 56 form two element antenna arrays. The elements 44 and 56 are connected by a transmission line that has a phase shift (nominally 180 degrees or half wavelength) such that the desired phase matching between the elements of the antenna pair is achieved.

Figure 2:
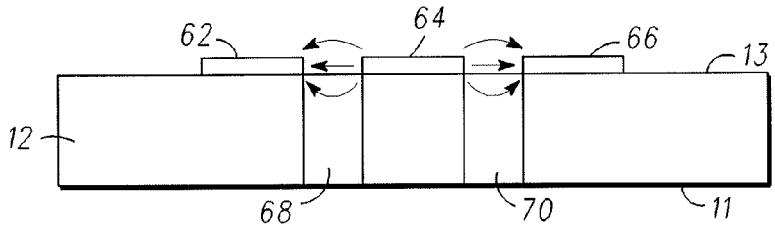
FIG. 2 is a partial side view of an initial step in the formation of an exemplary embodiment.

FIG. 2 is a partial side view of the coplanar strip transmission lines 38, 40, 46, 52, and 58, taken along the line 2-2, for example, of FIG. 1. The fabrication of the coplanar strip transmission lines 38, 40, 46, 52, and 58 involve the creation of three adjacent traces 62, 64, and 66 formed on the substrate 12. These traces 62, 64, and 66 may be formed on a first surface 13 (or side) of the substrate 12 by selectively introducing or removing various materials. The patterns that define such traces may be created by lithographic processes. For example, a layer of photoresist material is applied onto a layer overlying the substrate. A photomask (containing clear and opaque areas) is used to selectively expose this photoresist material by a form of radiation, such as ultraviolet light, electrons, or x-rays. Either the photoresist material exposed to the radiation, or that not exposed to the radiation, is removed by the application of a developer. An etch may then be applied to the layer not protected by the remaining resist, and when the resist is removed, the layer overlying the substrate is patterned. Alternatively, an additive process could also be used, e.g., building a structure using the photoresist as a template. Yet another method of forming the traces 62, 64, and 66 may be by ink jet printing. The traces 62, 64 and 66 are spatially positioned on the substrate 12 wherein the width, or distance between the traces 62 and 64, and between traces 64 and 66, preferably is in the range of 25 to 500 microns.

Figure 3:
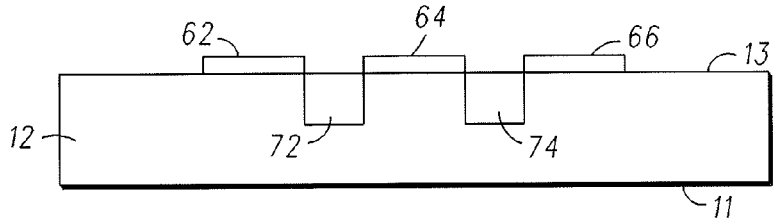
FIG. 3 is a partial side view of a first exemplary embodiment.
Figure 4:
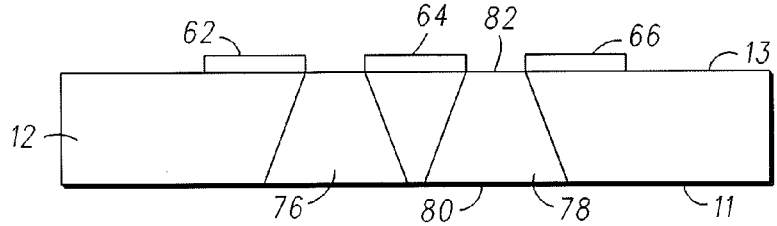
FIG. 4 is a partial side view of a second exemplary embodiment.

Referring to FIG. 2, slots 68 and 70 are formed between traces 62 and 64, and traces 64 and 66, respectively. The slots 68 and 70 may be created by mechanical drilling, laser burning, or any method of forming a slot in the substrate 12 known in the industry. Alternatively, the 68 and 70 may be formed prior to the traces 62, 64, and 66 being formed. While the slots 68 and 70 extend through the substrate 12, a second embodiment is shown in FIG. 3 wherein the slots 72 and 74 extend only partially through the substrate 12. A third embodiment of FIG. 4 shows the slots 76 and 78 being tapered so the lower portion 80 at surface 11 of the substrate is larger in area than the area of the upper portion 82 at the surface 13 of the substrate. Mechanical support may be added by leaving small connectors (not shown) of the substrate 12 material extending across the slots 68, 70, 72, 74, 76, 80. The connectors would preferably be small enough to not affect a signal being transmitted through the slots 68, 70, 72, 74, 76, 80.

A fourth embodiment (FIG. 5) comprises slots 68 and 70 as in FIG. 2, but the walls 84 and 86 of the slot 68 are coated with a metal 88 and 90, respectively. Likewise, the walls 92 and 94 of the slot 70 are coated with a metal 96 and 98, respectively. The existence of the metal 88 and 90 increase the capacitance between the two slots 68 and 70, therefore allowing for the slots 68 and 70 to have a greater distance therebetween.

Figure 5:
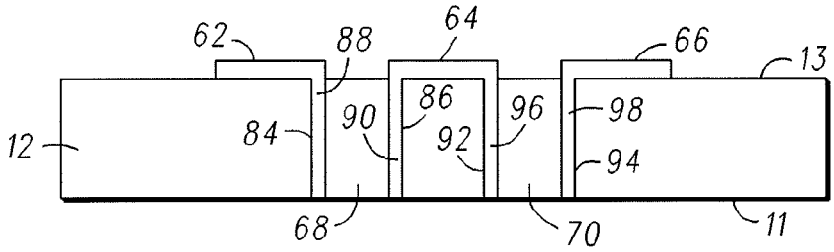
FIG. 5 is a partial side view of a third exemplary embodiment.
Figure 6:
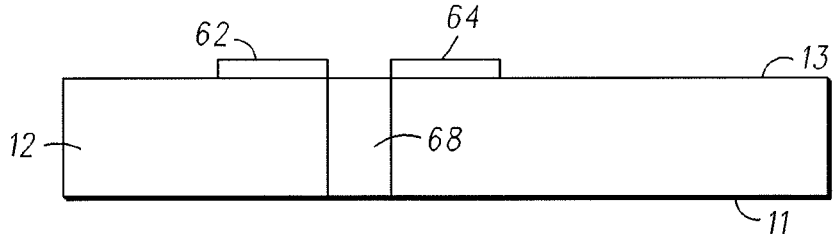
FIG. 6 is a partial side view of a fourth exemplary embodiment.

FIG. 6 shows a fifth embodiment that includes only two conductive traces 62 and 64, taken along the line 6-6 of FIG. 1 with the slot 68 formed therebetween. This two trace embodiment may also comprise the slot extending part way through the substrate 12 as shown in the embodiment of FIG. 3, a tapered slot as shown in the embodiment of FIG. 4, or have metal formed on its sides as shown in FIG. 5.

Referring again to FIG. 1, the antennas 42, 44, 54, and 56 each comprise (specifically in the case of antenna 42) a first antenna trace 41 coupled to the conductive trace 62 and a second antenna trace 43 coupled to the conductive trace 64. A slot 45 is formed between the first antenna trace 41 and the second antenna trace 43, and is in line with, or is extended from, the slot 68, to the edge (in this particular exemplary embodiment) of the substrate 12.

Figure 7:
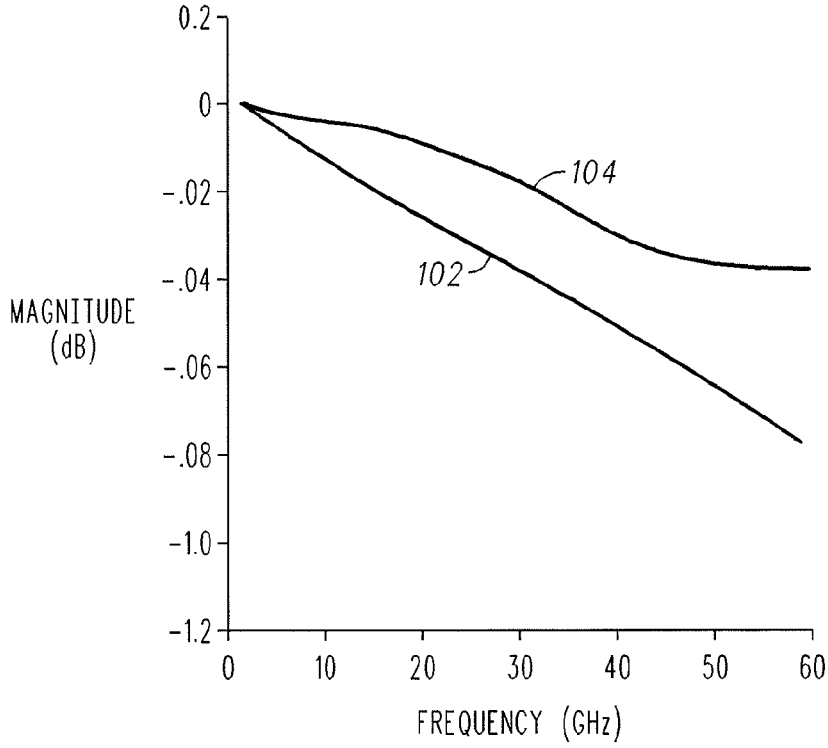
FIG. 7 is a graph comparing the dB loss of the exemplary embodiments with a known structure.

FIG. 7 is a simulated graphical representation illustrating the magnitude in dB versus the frequency in GHz of a high frequency signal 102 without the slots in the substrate 12 and a high frequency signal 104 with the slots in the substrate. It may be noted that at 60 GHz, the dB loss of the signal 102 is 8 dB per inch, while the dB loss of the signal 104 transmitted in accordance with the exemplary embodiments is only 4 dB per inch.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. An electronic device including a substrate having opposed first and second surfaces, comprising:

electronic circuitry positioned on the first surface of the substrate and including at least two components transmitting high frequency signals therebetween; and a coplanar strip transmission line coupled between the at least two components, the coplanar strip transmission line comprising:

a first conductive trace formed on a first surface of the substrate; and a second conductive trace formed on the first surface and spatially positioned from the first conductive trace, wherein the substrate defines a first slot between the first and second conductive traces and extending into the substrate from the first surface;

wherein the first slot extends through the substrate to the second surface.

2. The electronic device of claim 1 wherein the substrate comprises FR4 material.

3. The electronic device of claim 1 wherein the first slot extend partially through the substrate.

4. The electronic device of claim 1 wherein the first slot is tapered, the area of the first slot at the first surface is less than the area of the first slot at the second surface.

5. The electronic device of claim 1 wherein the first slot comprises at least one wall having metal formed thereon.

6. The electronic device of claim 1 further comprising:

a third conductive trace formed on the first surface and spatially positioned from the first conductive trace and on a side of the first conductive trace opposed from the second conductive trace, wherein the substrate defines a second slot between the first and third conductive traces and extending into the substrate from the first surface.

7. The electronic device of claim 1 wherein one of the components comprises an antenna coupled to the coplanar strip transmission line, the antenna comprising a first antenna trace positioned on the first surface and coupled to the first conductive trace; and a second antenna trace positioned on the first surface, coupled to the second conductive trace, and spaced from the first antenna trace by a second slot extending into the substrate from the surface.

8. The electronic device of claim 7 wherein the at least two components includes one of the devices selected from the group consisting of a receiver, a transmitter, and a transceiver, and including low frequency devices and high frequency devices coupled by the coplanar strip transmission line.

9. An electronic device comprising:

a substrate having a first surface and defining first and second spaced, parallel slots extending from the first surface into the substrate;

a first conductive trace positioned on the first surface and between the first and second, spaced, parallel slots;

a second conductive trace positioned on the first surface and adjacent the first spaced, parallel slot and on a side of the first slot opposed to the first conductive trace;

a third conductive trace positioned on the first surface and adjacent the second spaced, parallel slot and on a side of the second slot opposed to the first conductive trace;

an antenna coupled to the coplanar strip transmission line, the antenna comprising a first antenna trace positioned on the first surface and coupled to the first conductive trace; and a second antenna trace positioned on the first surface, coupled to the second conductive trace, and spaced from the first antenna trace by a third slot extending into the substrate from the surface.

10. The electronic device of claim 9 wherein the substrate comprises FR4 material.

11. The electronic device of claim 9 wherein the first and second slots are tapered, the area of the first slot at a first end is less than the area of the first slot at a second end, and the area of the second slot at a third end is less than the area of the second slot at a fourth end.

12. An electronic device including a substrate having a surface, comprising:

electronic circuitry positioned on the substrate and including at least two components transmitting high frequency signals therebetween; and first and second parallel, spaced conductive traces positioned on the substrate, wherein the substrate defines a first slot extending into the substrate and between the first and second parallel, spaced conductive traces;

wherein the at least two components includes one of the devices selected from the group consisting of a receiver, a transmitter, and a transceiver, and including low frequency devices and high frequency devices coupled by the first and second parallel, spaced conductive traces.

13. The electronic device of claim 12 further comprising:

a third parallel, spaced conductive trace positioned on the substrate and spatially positioned on a side of the first conductive trace opposed from the second conductive trace, wherein the substrate defines a second slot between the first and third conductive traces and extending into the substrate.

14. The electronic device of claim 12 wherein the first and second slots are tapered.

15. The electronic device of claim 12 wherein the first slot comprises at least one wall having metal formed thereon.

16. The electronic device of claim 12 further comprising an antenna comprising a first antenna trace positioned on the substrate and coupled to the first conductive trace; and a second antenna trace positioned on the substrate, coupled to the second conductive trace, and spaced from the first antenna trace by a second slot extending into the substrate from the surface.

* * * * *

UNITED STATES PATENT AND TRADEMARK OFFICE

CERTIFICATE OF CORRECTION

PATENT NO. : 7,791,437 B2
APPLICATION NO. : 11/675152
DATED : September 7, 2010
INVENTOR(S) : Franson It is certified that error appears in the above-identified patent and that said Letters Patent is hereby corrected as shown below:

On the Face Page, in Field (56), under "OTHER PUBLICATIONS", in Column 2, Line 4, delete "Coplanor" and insert -- Coplanar --, therefor.

On Page 2, in Field (56), under "OTHER PUBLICATIONS", in Column 1, Line 4, delete "bandwith," and insert -- bandwidth, --, therefor.

In Column 3, Line 2, delete "RF4" and insert -- FR4 --, therefor.

In Column 3, Line 4, delete "RF4" and insert -- FR4 --, therefor.

In Column 3, Line 7, delete "reasons, RF4" and insert -- reasons, FR4 --, therefor.

In Column 3, Line 9, delete "devices. RF4" and insert -- devices. FR4 --, therefor.

Signed and Sealed this
Seventh Day of August, 2012

David J. Kappos

David J. Kappos
*Director of the United States Patent and Trademark Office*